US007086408B2

(12) United States Patent
Stroppolo

(10) Patent No.: US 7,086,408 B2
(45) Date of Patent: Aug. 8, 2006

(54) MULTIPURPOSE SYSTEM FOR THE AUTOMATIC WASHING AND DRYING OF INDUSTRIAL CONTAINERS AND APPLIANCES IN CONTROLLED ENVIRONMENTAL CONDITIONS

(75) Inventor: Federico Stroppolo, Mezzovico (CH)

(73) Assignee: Alpex Pharma S.A., Mezzovico (CH)

( * ) Notice: Subject to any disclaimer, the term of this patent is extended or adjusted under 35 U.S.C. 154(b) by 0 days.

(21) Appl. No.: 10/986,473

(22) Filed: Nov. 11, 2004

(65) Prior Publication Data

US 2005/0103366 A1 May 19, 2005

(30) Foreign Application Priority Data

Nov. 19, 2003 (EP) ..... 03026436

(51) Int. Cl.
*B08B 3/02* (2006.01)

(52) U.S. Cl. ..... 134/167 R; 134/169 R; 134/170; 134/171; 134/168 R; 134/200

(58) Field of Classification Search ..... 134/167 R, 134/168 R, 166 R, 170, 171, 169 R, 200
See application file for complete search history.

(56) References Cited

U.S. PATENT DOCUMENTS

| | | | | | |
|---|---|---|---|---|---|
| 255,581 | A * | 3/1882 | Hatfield | 112/242 |
| 2,275,411 | A * | 3/1942 | Ashe | 134/182 |
| 2,629,392 | A * | 2/1953 | Davis | 134/183 |
| 3,041,212 | A * | 6/1962 | Booth | 134/21 |
| 3,073,325 | A * | 1/1963 | Rebizzo et al. | 134/148 |
| 3,078,861 | A * | 2/1963 | Miller | 134/96.1 |
| 3,122,151 | A * | 2/1964 | Chambers | 134/99.1 |
| 3,216,429 | A * | 11/1965 | Dick | 134/102.1 |
| 3,688,782 | A * | 9/1972 | Smith | 134/58 R |
| 3,736,948 | A * | 6/1973 | Crosswhite | 134/95.2 |
| 4,166,481 | A * | 9/1979 | Farris et al. | 141/1 |
| 4,421,132 | A * | 12/1983 | Kuhl | 134/123 |
| 4,452,263 | A * | 6/1984 | McClure | 134/45 |
| 4,635,666 | A * | 1/1987 | Daley et al. | 134/172 |
| 4,655,235 | A * | 4/1987 | Scott, Jr. | 134/99.1 |
| 5,106,428 | A * | 4/1992 | Goerss et al. | 134/38 |
| 5,601,102 | A * | 2/1997 | Rivette et al. | 134/62 |
| 5,640,643 | A * | 6/1997 | Hoitz et al. | 396/661 |
| 5,887,750 | A * | 3/1999 | Popp et al. | 220/681 |
| 5,937,875 | A * | 8/1999 | Nygren | 134/22.11 |
| 6,132,509 | A * | 10/2000 | Kuschnereit | 118/64 |
| 2003/0201002 | A1 * | 10/2003 | Chen et al. | 135/95.3 |
| 2004/0079404 | A1 * | 4/2004 | Burrows | 134/200 |

FOREIGN PATENT DOCUMENTS

| | | | |
|---|---|---|---|
| FR | 2758746 | * | 7/1998 |
| GB | 742894 | * | 1/1956 |

OTHER PUBLICATIONS

Europena Patent Office 1 002 589 May 2000.*

* cited by examiner

*Primary Examiner*—Frankie L. Stinson
(74) *Attorney, Agent, or Firm*—James V. Costigan; Hedman & Costigan

(57) ABSTRACT

The present invention relates to a multipurpose system for the automatic washing and drying of industrial containers and appliances, in controlled environmental conditions.

7 Claims, 4 Drawing Sheets

MULTIPURPOSE SYSTEM FOR THE AUTOMATIC WASHING AND DRYING OF INDUSTRIAL CONTAINERS AND APPLIANCES IN CONTROLLED ENVIRONMENTAL CONDITIONS

The present innovation relates to a multipurpose system for the automatic washing and drying of industrial containers and appliances in controlled environmental conditions.

More particularly it is a system which comprises a washing booth with an entrance door and an exit door, connected so as not to be able to open simultaneously, and wherein mobile means are provided which traverse the whole height of the booth, capable of aiming, against the objects to be washed, jets of purified water and, subsequently, jets of filtered air for drying.

The base of the booth consists of a grid panel, placed at the same level as the floor of the room wherein the booth is installed so as to be able to move the appliances to be washed inside and outside the booth, without difficulty.

The walls and base of the booth are smooth, without protuberances and without corners, so as to avoid areas of pooling of washing water and/or accumulated dirt.

All the parts which come into contact with the washing fluids are in stainless steel and electronic management and control systems are provided for proper operation of the system.

The system according to the invention allows the automatic washing of containers and appliances, to be used for example in the food or pharmaceuticals industry, ensuring performance of the operations in ideal conditions of hygiene and preventing sprays of contaminated liquid from possibly coming into contact with the objects washed.

The problem of thorough washing of appliances and containers is prominent in various areas, including more particularly the food and pharmaceuticals industries. Safety reasons, linked to the need to avoid contamination of products and to the proliferation of bacteria in the rooms and on the equipment, impose strict regulations to avoid any risk to consumers health.

Work therefore has to be carried out in maximum hygiene conditions and, as part of the many precautions to be taken, the need also arises for the possibility of washing thoroughly, with total hygiene, used containers and appliances before further use.

Until a few years ago the operations of washing equipment were carried out by hand, with all the disadvantages arising from the fact that the result was not constant or predictable in that it depended on the ability and conscientiousness of staff employed for this work, and on their level of experience and the physical features (size, shape) of the appliances to be washed.

As the art developed, solutions were created for automating and standardising methods of washing.

However, with these new systems too, the washing operation was normally performed in zones wherein the washed appliances could come into contact with those yet to be washed, with the risk that they could be contaminated by dirty appliances waiting to be washed.

Given that the water used for washing is one of the. most critical elements and risks contaminating clean appliances, the most recent systems adopt purified water, for example of the Pharmacopeia PW type, for washing and rinsing.

This however is not sufficient as this purified water may form an environment suitable for encouraging the development and growth of bacteria, so that pooling has to be prevented and any trace of water removed immediately after washing by means of separate drying systems.

Moreover purified water is highly corrosive for metals which contain iron and generates traces of rust which in turn constitute a contaminating element.

Another source of contamination is represented by the dust in the environment which, removed from dirty equipment, may then deposit on those newly washed.

Substantially, at the current state of the art, systems have not been provided which are capable of guaranteeing effective and safe washing and drying of a container or appliance and of operating in hygienic and safe conditions.

The problem is now solved by the present invention, which provides a multipurpose system for the automatic washing and drying of industrial appliances and containers in controlled environmental conditions, which is characterised by the special configuration and arrangement of the parts, such as to allow effective washing and subsequent drying of containers or appliances in conditions of total hygiene.

The present invention will now be described in detail by way of a non-limiting example, with reference to the accompanying drawings, in which.

Figure 1:
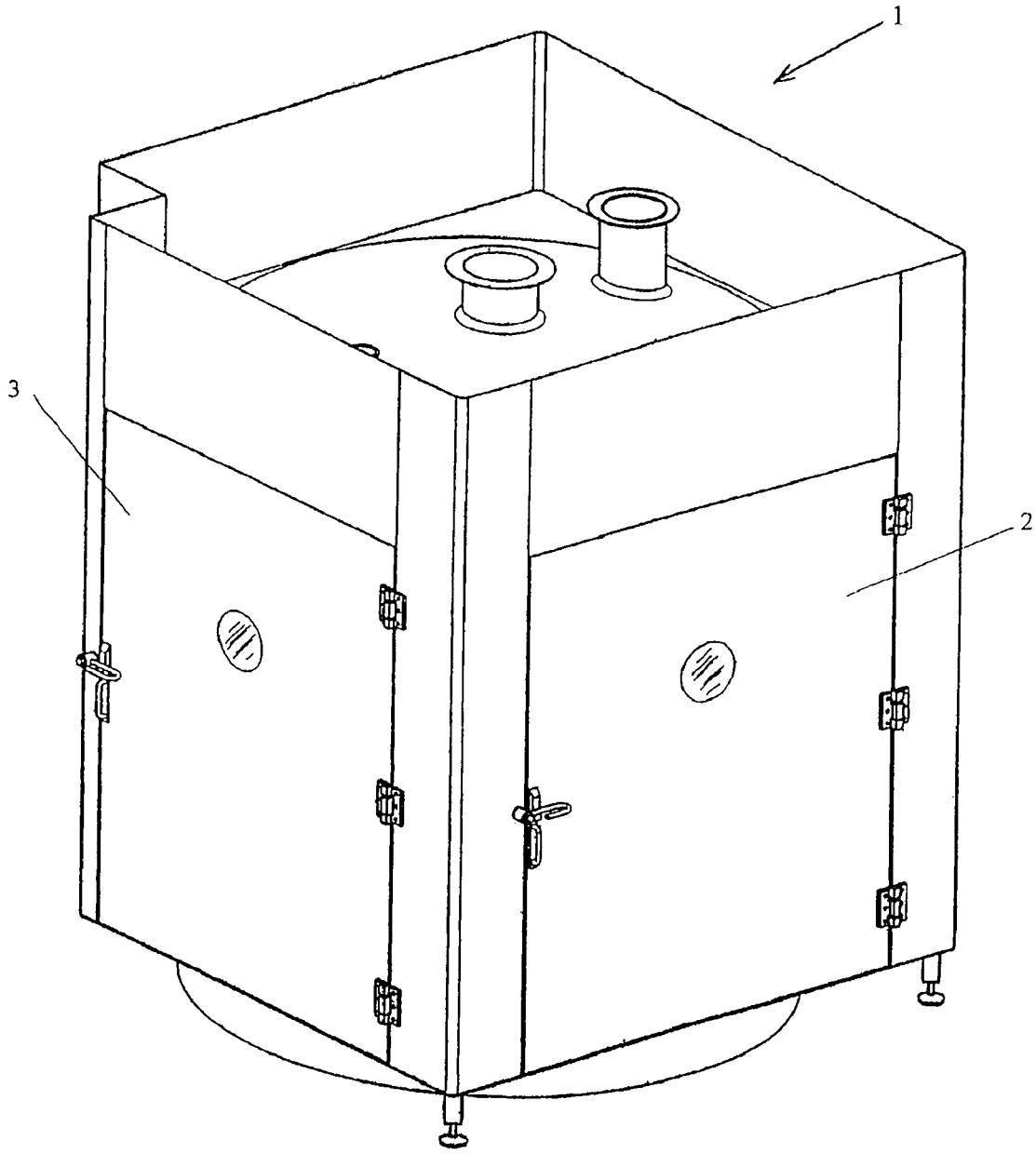
FIG. 1 is a schematic perspective view of a washing booth according to the invention.

Referring to FIG. 1, the washing system according to the invention comprises a booth, denoted overall by 1, wherein the appliances to be washed are placed and which is closed by two doors with perimeter seal strips, denoted respectively by 2 and 3, one door intended for insertion and the other door for withdrawal of the appliance to be washed.

One feature of the invention arises from the fact that means, not illustrated in detail in that of a known type, are provided which prevent simultaneous opening of the two doors, allowing each one of the two to be opened only if the other one is properly closed.

Figure 2:
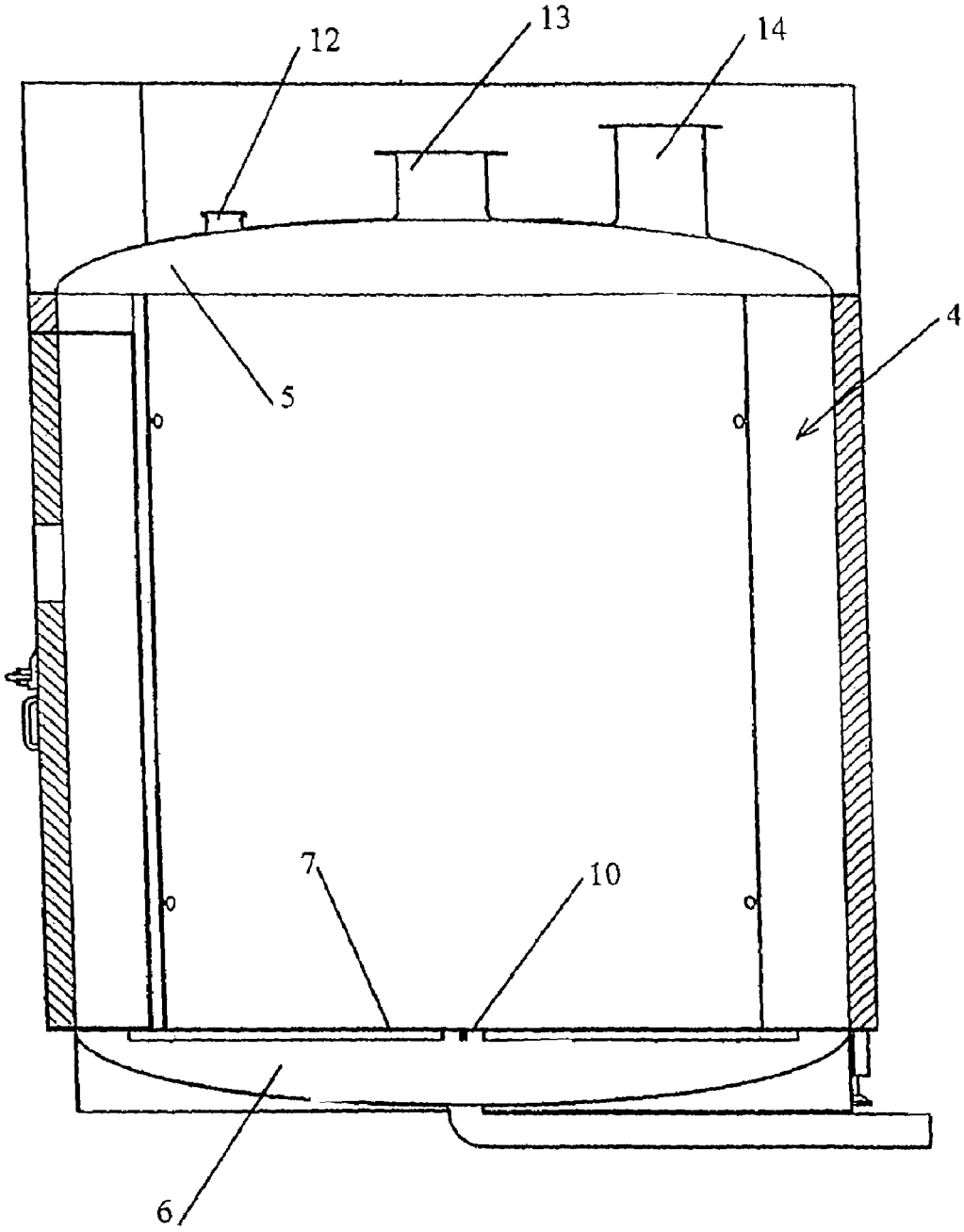
FIG. 2 illustrates a sectioned view of the washing booth according to the invention.

Inside the booth there is a substantially cylindrical container 4 (see FIG. 2), closed at the head by an upper wall 5 and at the base by a lower wall 6, both walls 5 and 6 being convex and preferably hemispherical.

The advantage provided by this configuration, is represented by the fact that the walls are perfectly smooth, without corners, protuberances or irregularities on the surface which could create pooling of washing water or form areas of accumulated dirt or contaminants.

On the base of the cylindrical container 4 there is a grid 7 formed by a series of segments 8, which overall forms the support surface whereon the devices to be washed are placed and which, once the assembly has been mounted, is situated at the same level as the floor of the room wherein the booth is installed, to allow easier insertion and removal of the units to be washed.

The holes of the grid 7 are substantially conical in shape so as to aid the outflow of water towards the base of the container, preventing however any sprays from rising up and reaching the newly washed equipment.

Figure 4:
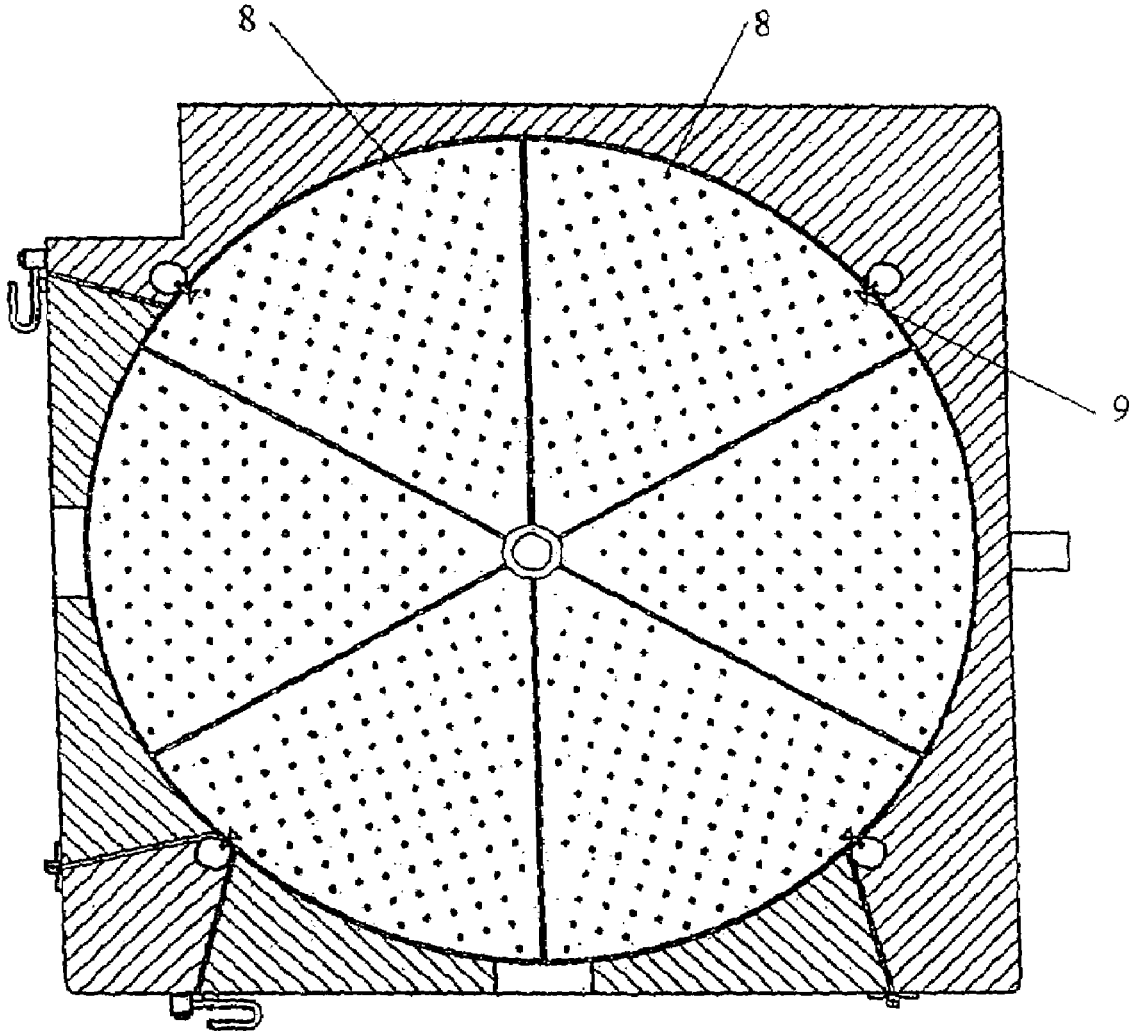
FIG. 4 is a view of the base of the booth according to the invention.

There are one or more pairs of spraying nozzles on the wall of the booth, denoted by 9 in FIG. 4, connected to known systems for feeding pressurised washing water which is sprayed inside the booth, hitting the container or appliance to be washed externally. A nozzle 10, connected via a conduit 11 to the devices which pump pressurised water, is positioned on the base of the container, at the centre of the latter.

The upper part 5 of the container 4 has three openings, denoted respectively by reference numerals 12, 13 and 14. The opening 13, in a central position, is used to insert a telescopic pipe 15 (see FIG. 3), connected to a conduit 26 via which heated and filtered air is pumped for drying.

Inside the telescopic pipe 15 a second support 16 is mounted, also telescopic, for a series of nozzles 17 which spray pressurised washing water from the inside against the walls of the container to be washed. The pipe 16 for supporting the nozzles 17 can rotate around its own axis, so as to distribute the jet over the whole internal surface to be washed.

A conduit 19 is connected to the opening 14 for extraction of the drying air, while the opening 12 is closed by glass and is used to illuminate the interior of the booth.

It should also be noted that the telescopic pipes 15 and 16, like the booth, have perfectly smooth walls, without corners and roughness, in this way avoiding the risk of pooling of water.

The operation takes place as follows.

The appliance to be washed is entered through the door 2 which is then closed tight again, thanks to a seal around the whole of the perimeter. At this point the washing cycle can be started, spraying pressurised water through the nozzles 9 distributed along the side walls, the nozzle 10 positioned on the base and the nozzles 17 mounted on the rotating head integral with the telescopic support 16.

Figure 3:
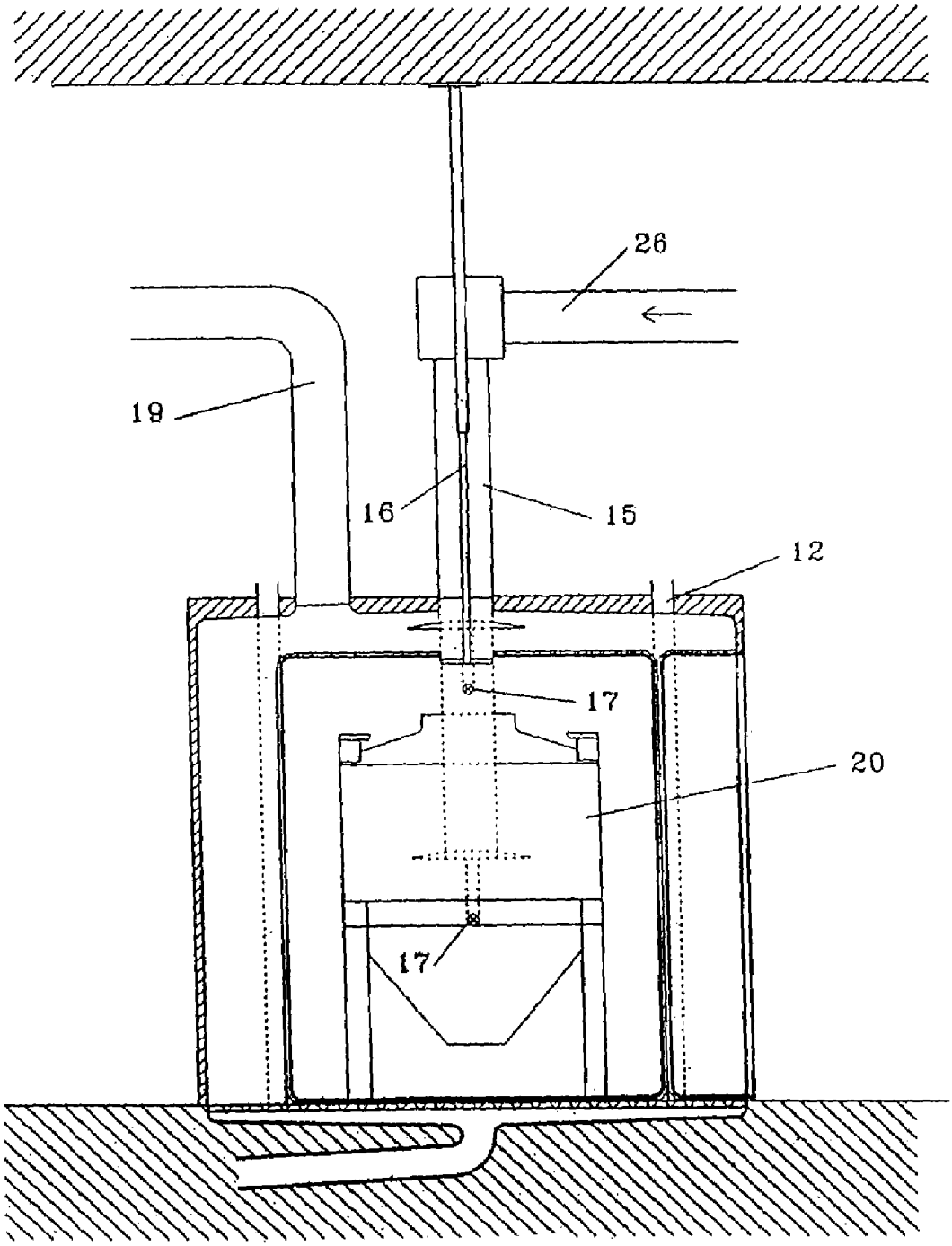
FIG. 3 is a vertical section of the washing system comprising the booth according to the invention.

The pressurised water jets hit the appliance or the container to be washed, denoted by reference numeral 20 in FIG. 3, cleaning it completely. During this phase the telescopic support is raised and lowered, making it traverse the whole height of the booth, so as to ensure complete cleaning of the interior.

The washing water passes through the grid and is collected on the base of the container, from which it is then discharged along the conduit 11.

After washing, the drying phase starts up, with appropriately filtered and possibly heated air which, through the conduit 16, is aimed along the telescopic pipe 15 and from there against the internal walls of the appliance to be washed.

At the end, a flow of hot air is aimed against the external surface of the appliance to be washed through the conduits 21, provided with slots, positioned on the side walls of the booth.

After the drying operation, the appliance, now dry, can be removed through the door 3, with the door 2 which remains blocked, thus avoiding the risk of bacterial or polluting substances penetrating through this opening into the booth.

As will be made clear from the description given, thanks also to the installation of a computerised control system, not illustrated in that of a known type, the cycle of washing of the containers and appliances can be fully automated, always ensuring conditions of maximum hygiene and sterility.

Obviously the dimensions, and also the materials used, may vary according to the conditions of use.

The invention claimed is:

1. Multipurpose system for automatic washing and drying of industrial containers and appliances in controlled environmental conditions characterized in that it provides:

a container (4) having front, back and side walls, said container being designed to act as a washing booth;

a plurality of nozzles (9) designed to aim a pressurised washing liquid towards an appliance, said nozzles being placed inside said container;

means (15, 19) designed to circulate a flow of drying air inside said booth;

wherein all walls of said booth are smooth, without corners or protulberances, to avoid any pooling of water and wherein said plurality of nozzles (9), are placed on the side walls of said container and are designed to aim a pressurized washing liquid towards the interior of the container;

at least one nozzle (10) designed to spray a washing liquid, said nozzle being placed on a base panel of the container;

one or more nozzles (17) designed to spray a washing liquid at high pressure said nozzles (17) being mounted on a telescopic support (16) in telescopic pipe (15), said telescopic support (16) being designed to move said nozzles along the whole height of the container;

a door (2) in a wall for entry or a part and an exit door (3), installed in another wall, means being provided which are designed to allow opening of one single door at a time.

2. Multipurpose washing and drying systems according to claim 1, wherein said means (15,19) designed to circulate a flow of drying air inside said booth, comprise at least one appliance designed to extract heated air coming from external devices and to feed said heated air into the booth through said telescopic pipe (15), and having an exit opening in one of the walls of the booth.

3. A system according to claim 1 characterized in that it provides on the base panel of each container (4), at the central zone, a washing nozzle (10), designed to spray pressurized washing water from below against the appliance to be washed.

4. System according to claim 3, characterized in that the base panel of the container (4), wherein objects to be washed are placed, is formed by a grid (7), made up of a series of removable segmented elements (8), which form the base panel of the booth whereon the objects are placed.

5. Washing systems according to claim 4, characterized in that said grid has conical holes designed to prevent possible sprays from rising above a base level of said container.

6. Washing system according to claim 5, characterized in that said grid (7) is placed at floor level of the room wherein the washing system is installed.

7. Washing system according to any of the previous claims, characterized in that it provides door (2, 3) for inserting and withdrawing the objects to be washed which are installed in two different walls, means being provided which are designed to allow opening of one single door at a time and control means designed to prevent opening of the doors before the end of the washing treatment, said devices allowing opening of the insertion door only after the withdrawal door has been opened and a washed device has already been removed.

* * * * *